US007446671B2

(12) United States Patent
Giannopoulos et al.

(10) Patent No.: US 7,446,671 B2
(45) Date of Patent: Nov. 4, 2008

(54) METHOD OF CONFIGURATION A WIRELESS-CONTROLLED LIGHTING SYSTEM

(75) Inventors: Demetri Giannopoulos, Norwalk, CT (US); Ling Wang, Millwood, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 255 days.

(21) Appl. No.: 10/539,983

(22) PCT Filed: Dec. 11, 2003

(86) PCT No.: PCT/IB03/05946

§ 371 (c)(1),
(2), (4) Date: Jun. 19, 2005

(87) PCT Pub. No.: WO2004/057927

PCT Pub. Date: Jul. 8, 2004

(65) Prior Publication Data

US 2006/0049935 A1 Mar. 9, 2006

Related U.S. Application Data

(60) Provisional application No. 60/434,577, filed on Dec. 19, 2002.

(51) Int. Cl.
*G08B 1/08* (2006.01)

(52) U.S. Cl. ..... 340/825.72; 398/106

(58) Field of Classification Search ..... 340/825.72, 340/825.69, 310.11, 533; 315/291
See application file for complete search history.

(56) References Cited

U.S. PATENT DOCUMENTS

| | | | | |
|---|---|---|---|---|
| 5,544,037 | A | 8/1996 | Luger | |
| 6,292,901 | B1 * | 9/2001 | Lys et al. | 713/300 |
| 6,333,605 | B1 | 12/2001 | Grouev et al. | |
| 6,791,467 | B1 * | 9/2004 | Ben-Ze'ev | 340/825.69 |
| 6,969,954 | B2 * | 11/2005 | Lys | 315/155 |
| 7,123,140 | B1 * | 10/2006 | Denes | 340/539.1 |
| 2002/0126035 | A1 * | 9/2002 | Hou | 341/176 |
| 2002/0171378 | A1 * | 11/2002 | Morgan et al. | 315/291 |
| 2003/0020595 | A1 * | 1/2003 | Wacyk | 340/3.5 |

FOREIGN PATENT DOCUMENTS

| | | | |
|---|---|---|---|
| WO | WO02/13490 | A2 | 2/2002 |

* cited by examiner

*Primary Examiner*—Brian Zimmerman
*Assistant Examiner*—Nabil H Syed

(57) ABSTRACT

A method for associating a group of lighting units in a wireless-controlled lighting system to respective buttons or other control elements on a remote control. Each of the lighting units transmits, via modulation of its own illumination light, a unique identification code for the respective unit. The remote control is successively positioned to receive the modulated light from each lighting unit and, at each position, the user activates a respective control element of the remote control for association with the lighting unit. The remote control then transmits to a control master for the group the unique codes and codes identifying the respective control elements with which they have been associated.

18 Claims, 3 Drawing Sheets

METHOD OF CONFIGURATION A WIRELESS-CONTROLLED LIGHTING SYSTEM

CROSS REFERENCE TO RELATED APPLICATION

This application claims the benefit of U.S. provisional application Ser. No. 60/434,577 filed Dec. 19, 2002, which is incorporated herein by reference.

BACKGROUND OF THE INVENTION

1. Field of the Invention

This invention relates to wireless-control of lighting systems and, in particular, to the configuration of components within the system.

2. Description of Related Art

Wireless control of a lighting system provides many advantages besides the ability of remotely switching and dimming lighting units in the system. For example, such control provides a convenient way of setting up and making changes to a lighting system and of improving energy utilization. Features such as emergency lighting control can be added without making any wiring changes. Energy utilization by the system can be regulated by a program which can be readily modified to meet changing demands.

In order for a wireless-controlled lighting system to be readily accepted by users, however, a number of considerations must be addressed. In particular, the system must be capable of unambiguously controlling selected lighting units in the system and of incorporating lighting units which are later added to the system.

Commonly, wireless-controlled lighting systems include transceivers in a remote control and in controlled lighting units for enabling communications between users and a lighting system. Such communications (typically via IR or RF signals) are utilized to configure the lighting units and the remote control into a wireless network. If the remote is used as a master control, it is used to configure the system by, for example, binding each of the lighting units to a respective button on the remote. In one known method for effecting such binding, RF communications are used whereby:

- the remote transmits a command signal to put all of the lighting units within RF range into a learning mode;
- the lighting units transmit pre-assigned identification (ID) numbers to the remote;
- the remote successively transmits each of the ID numbers, causing the lighting units to light, and the user associates each newly-lighted unit with a respective button on the remote by momentarily depressing the button.

This system is relatively simple, but since RF signals pass through walls, it can cause the lighting of lighting units in locations that are not within sight of the user. Further, if the remote is lost or becomes inoperable the entire system must be reconfigured with a replacement remote. Also, the system requires that each lighting unit have a pre-assigned ID number, which is assigned to the lighting unit by the manufacturer. This limits the types of new and replacement lighting units that can be incorporated into the system.

In systems effecting master-slave control by utilizing a master device in one of the lighting units and slave devices in the other lighting units in the system, additional complications arise. The supplier of the devices must now provide two types of lighting unit—one with a master device and the other with a slave device. The installer of the lighting units must ensure that one, and only one, master device be installed in a wireless network. This places an additional burden on the supplier and increases the likelihood of errors in installation and set up of lighting systems.

SUMMARY OF THE INVENTION

It is an object of the invention to provide a method which avoids the foregoing disadvantages.

In accordance with the invention, a method is provided for associating a group of lighting units with respective control elements of a remote control, in a wireless-controlled lighting system. Each of the lighting units transmits a modulated light signal carrying a unique identification code for the lighting unit. The remote control is positioned at a location where it receives the modulated light signal from only one of the lighting units. A user activates a selected one of the control elements of the remote control to associate the control element with the lighting unit transmitting the modulated light signal being received. The remote control transmits to a control master a signal identifying the unique identification code for the lighting unit and the control element with which the lighting unit has been associated. Each of the above steps is repeated for each of the remaining lighting units in the group.

The lighting unit IDs are transmitted to the remote control via modulated light signals from the lighting units themselves, so there is no problem with inadvertently associating lighting units that are out of sight of the user. The associated lighting unit IDs and remote control elements are transmitted to a control master where they can be stored, thus simplifying reconfiguration of the system if the remote is lost. The method, in accordance with the invention, functions with both systems in which the lighting unit IDs are preassigned by the lighting unit manufacturer and systems in which the lighting unit IDs are generated at the time of configuration (e.g., in accordance with the initialization procedure used in DALI), so no limitation in this regard is placed on the system.

In a preferred form of the invention, each lighting unit in the group includes a convertible device which can operate as either a master or a slave. This avoids the need for both master and slave types of lighting units and decreases the likelihood of errors in installation and set up of lighting systems.

DESCRIPTION OF THE PREFERRED EMBODIMENT(S)

Figure 1:
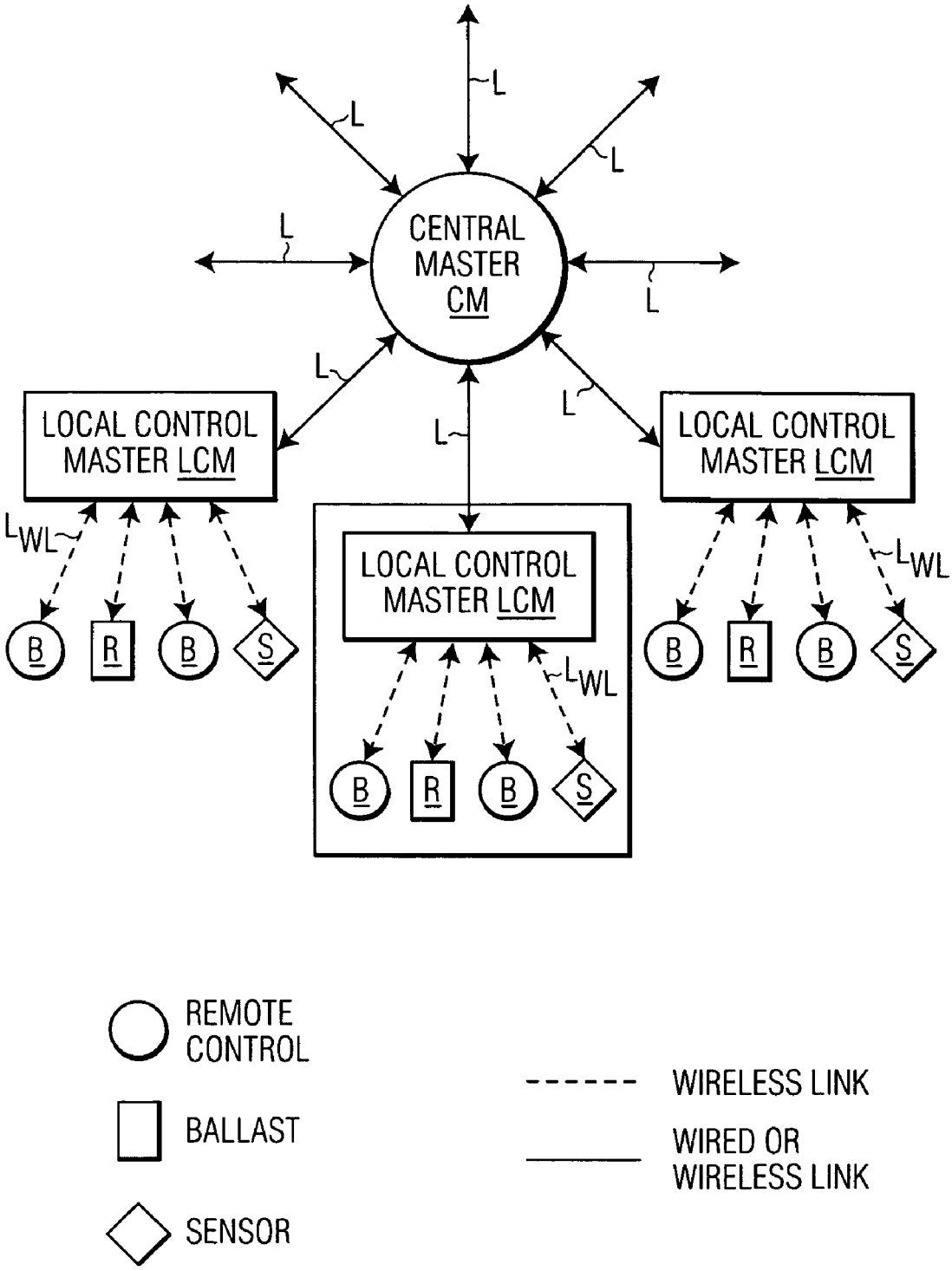
FIG. 1 is a schematic drawing of a lighting-control system incorporating an embodiment of the invention.

FIG. 1 illustrates an exemplary lighting-control system in which the invention is utilized. The system shown includes a number of local control masters LCM, each communicating with a central master CM via a wired or wireless link L. The choice of which type of link to be utilized for coupling each individual local control master to the central master is optional and depends on various factors. For example, wired links are commonly used in new lighting installations, while wireless links are commonly used in both retrofit and in new installations.

The central master CM functions to provide central control and monitoring of the entire lighting system (such as all rooms in a building or building complex), while each local control master LCM functions to provide control and monitoring within a local area (such as within one or more rooms of a building). The local control masters LCM communicate via respective wireless links $L_{WL}$ to lighting-system components including lighting units B, sensors S and remote controls R. The lighting units may be of any type or combination of types, e.g. fluorescent, high-intensity discharge (HID), light-emitting diodes (LEDs), incandescent etc. The sensors S provide the capability of detecting and reporting different types of information, e.g. the presence and/or motion of a person and ambient conditions such as light intensity and/or temperature. Each remote control R enables a user to select and control operation of lighting units within one or more local areas. Other types of system components, e.g. thermostats, powered window curtains, etc. may also be linked to the local control masters.

Each local control master LCM and the system components B, S and R to which it is linked collectively forms a local-area network LAN. A master-slave wireless linking is established between each local control master LCM and the components B, S and R. This is achieved by including a master device in each LCM and including a slave device in each of the components B, S, and R. Similarly, a master-slave wireless linking may be established between the central master CM and each of the local control masters LCM by including a master device in the CM and a slave device in each LCM.

Generally, each local control master LCM functions to establish and coordinate operation of the respective LAN by, for example, identifying the slave devices within the LAN, initiating communications, and collecting information communicated within the respective LAN. Such collected information facilitates the formation of a wide-area network including several or all of the LANs and enables the association of a substitute remote control R to a LAN in the event that an original remote control becomes lost or inoperable.

Figure 2:
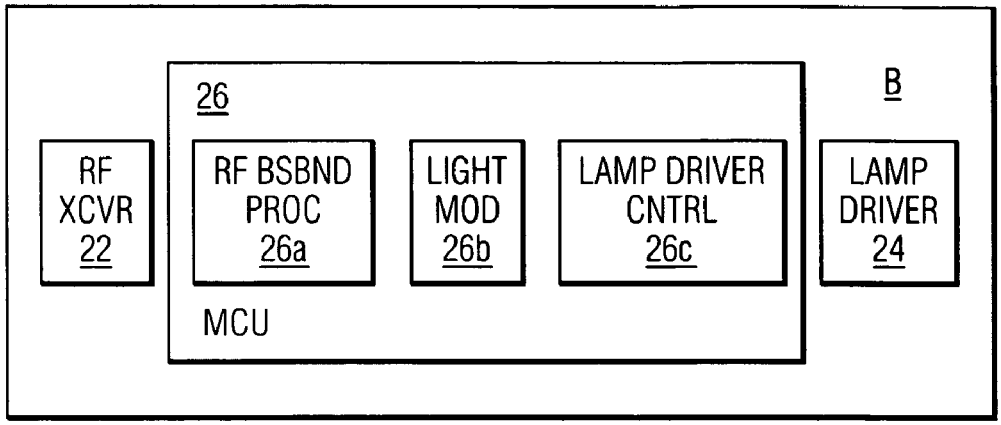
FIG. 2 is a block diagram of lighting unit circuitry utilized in an embodiment of the invention.
Figure 3:
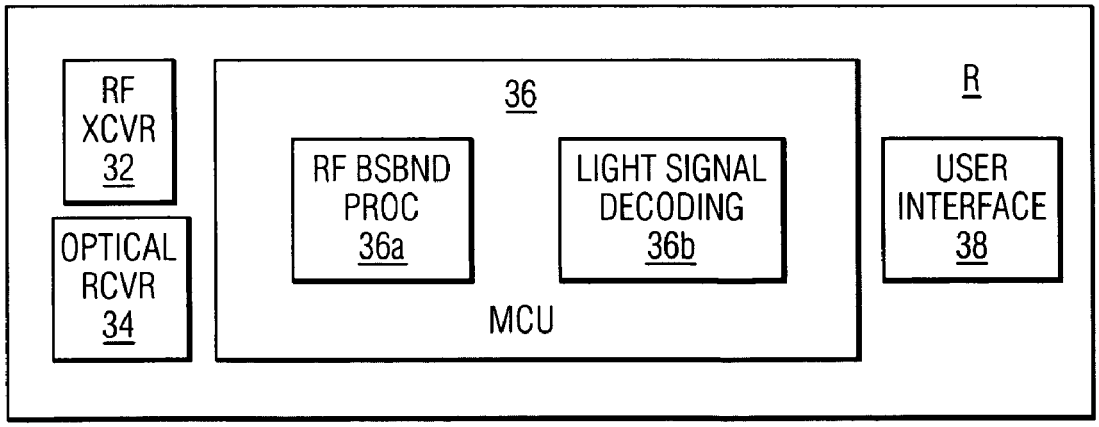
FIG. 3 is a block diagram of remote control circuitry utilized in an embodiment of the invention.

FIGS. 2 and 3, respectively, are block diagrams showing only that circuitry and functionality, incorporated in each lighting unit B (e.g. in a ballast for a fluorescent lamp, in a driver for LEDs or in a power supply of the lighting unit) and in each remote control R of a LAN, which is relevant to the preferred embodiment of the invention. Circuitry for the local control master LCM of the LAN is not described in detail, because the present invention is adaptable to use with a variety of different types of local control masters, which are well known in the art.

The lighting unit circuitry shown in FIG. 2 includes an RF transceiver 22 for establishing a radio link with the local control master LCM, lamp driver circuitry 24 for the type of lamp being used (e.g. fluorescent, HID, LED) and a micro-controller unit 26. Together, the transceiver 22 and the micro-controller 26 function as the slave device in each lighting unit B. The micro-controller 26 is programmed to perform the functions of RF base-band processing 26*a*, light modulation 26*b*, and lamp driver control 26*c*, which include the following:

The base-band processing function 26*a* converts signals provided to and received from the transceiver 22 in accordance with the protocols used in the lighting system. For example, commands in accordance with the DALI standard might be embedded in an RF communication protocol, such as ZIGBEE.

The light modulation function 26*b* controls the lamp driver 24 to modulate the illumination light produced by the respective lighting unit. This provides the capability of sending light modulated signals to the remote control 30. Alternatively, separate light-emitting components (e.g. an infrared-emitting LED and driver) may be added to the lighting unit for producing the modulated light.

The lamp driver control function 26*c* controls the lamp driver to perform basic functions, e.g. turning the lighting unit on or off, dimming the light output etc., in accordance with commands received from the local control master LCM via the RF transceiver 22.

The remote control R of FIG. 3 includes an RF transceiver 32 for establishing a radio link with the local control master LCM, optical receiver circuitry 34 for receiving the light modulated communications transmitted by each of the lighting units B, a micro-controller unit 36, and a user interface 38. Together, the transceiver 32 and the micro-controller 36 function as the slave device in the remote R. The micro-controller 36 is programmed to perform the functions of RF base-band processing 36*a* and light signal decoding 36*b*, which include the following:

The base-band processing function 36*a* converts signals provided to and received from the transceiver 32 in accordance with the protocols used in the lighting system.

The light signal decoding function 36*b* decodes the light modulated communications received by the optical receiver 34.

The user interface 38 includes circuitry for detecting remote control inputs from the user, e.g., via push buttons, a touch screen, voice etc.

In operation, each lighting unit already has a unique ID code, which is assigned to it either by the manufacturer or generated at the time the lighting unit is installed and joins the respective local area network LAN. The method, in accordance with the invention, of associating the lighting unit with the remote readily operates with either type of ID assignment. In the preferred embodiment, which is illustrated in the flow chart of FIG. 4:

At 40, a group of the lighting units in the system continuously transmit their respective ID codes via their modulated light outputs. This modulation should be at a frequency which is sufficiently high that no noticeable flicker occurs. Transmission of the ID codes is preferably done upon powering up of the lighting units and continues for a period which is at least as long as is needed to complete the association with the remote. The group may be any logical assortment of the lighting units, e.g. all lighting units in a room, all lighting units in a local area network, etc.

At 41, the remote R enters an association mode. This can be done in response to a transmission from the local control master or by the user activating a designated control element of the remote upon powering up of the lighting units in the group. The control elements can take any form which is available on the remote, such as a button (or sequence of buttons, e.g. 13), a symbol or location on a touch screen, a number or other sound produced by the user and interpreted by voice-recognition software in the user interface, etc.

Process 41*a* is optional and is not used in this embodiment of the invention.

At 42, the user brings the remote control R to one of the lighting units B in the group, positions the optical receiver 34 to receive only the modulated light signal carrying the respective lighting unit ID code, and selects and activates a control element on the remote to effect association of the lighting unit with that control element.

At 43, the remote control R transmits to the local control master LCM the ID code received from the lighting unit and a code identifying which button (or sequence of buttons) the lighting unit B has been associated with.

At 44, the local control master LCM stores both codes for future use.

At 45, the above steps are repeated until each lighting unit in the group is associated to a button (or sequence of buttons) of the remote control.

At 46, when all lighting units B in the group have been associated with respective buttons on the remote control R, the remote enters a normal mode. This can be done in response to a transmission from the local control master LCM or by the user pressing a designated button on the remote.

In the normal mode, the remote functions to control the operation of the lighting units by transmitting RF commands to the local control master LCM in response to user inputs. These inputs are effected by having the user select and activate control elements on the remote. For example, the user could touch the word "OFF" and then a selected symbol on a touch screen of the remote which is associated with a respective one of the lighting units. This will effect transmission of an OFF command along with the symbol associated with the lighting unit. Upon receipt of this command, the local control master LCM will look up the ID code of the lighting unit associated with the symbol and transmit an OFF command to the respective lighting unit. Alternatively, a single control element could be selected and used to effect changing the state (ON or OFF) and the brightness of a respective lighting unit associated with the control element. For example, if the control element is a button on the remote control, the state of the respective lighting unit could be changed by momentarily depressing the button or the brightness of the light produced by the unit could be changed by simply holding down the button to effect a continuous change in brightness and releasing the button then the desired brightness is reached.

Figure 4:
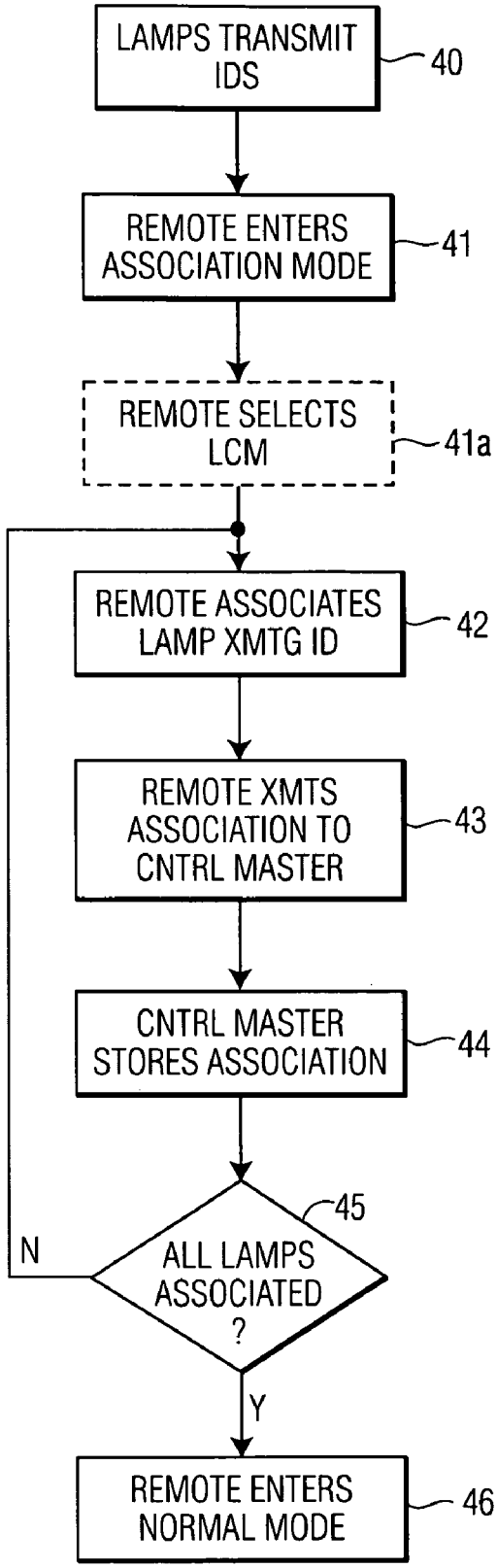
FIG. 4 is a flow chart of an exemplary routine performed in an embodiment of the invention.

In accordance with another embodiment of the invention, the transceiver 22 and the micro-controller 26 in each lighting unit B is adapted to selectively function as either a local control master or as a slave device. This can be very simply done by incorporating in the micro-controller for each lighting unit both the software utilized by the slave devices and that utilized by the local control master. This enables the local control master to be incorporated in any one of the lighting units by simple activating the corresponding software. As is shown in FIG. 4, this is done as follows:

At 41, the remote control enters the association mode in response to the user activating a designated control element of the remote.

At 41*a*, the user brings the remote control R to that lighting unit B in which it is desired to incorporate the local control master, positions the optical receiver 34 to receive only the modulated light signal carrying the respective lighting unit ID code, and activates a designated control element on the remote to effect selection of the local control master software in the lighting unit from which the remote is currently receiving the ID code.

What is claimed is:

1. In a wireless-controlled lighting system including a control master and a group of lighting units, all communicating via commonly-received wireless transmissions, a method of associating said group of lighting units, each having a unique identification code, with respective control elements of a remote control, said method comprising:

a. each of the lighting units transmitting a modulated light signal carrying the respective identification code;

b. positioning the remote control at a location where it receives the modulated light signal from only one of the lighting units;

c. activating a selected one of the control elements of the remote control to associate said control element with the lighting unit transmitting the modulated light signal being received;

d. transmitting from the remote control to the control master a signal identifying the unique identification code for the lighting unit and the control element with which said lighting unit has been associated;

e. repeating each of steps b through d for each of the remaining lighting units in the group, where each lighting unit in the group includes an adaptable device which selectively operates as either a control master device or a slave device.

2. A method as in claim 1 where the remote control selects one of the adaptable devices to operate as the control master for the group of lighting units.

3. A method as in claim 1 where the unique identification code is pre-assigned.

4. A method as in claim 1 where the unique identification code is assigned to each lighting unit when the lighting unit is installed in the system.

5. A method as in claim 1 where each of the lighting units transmits the modulated light signal for a predetermined period after said lighting unit is powered up.

6. A method as in claim 1 where the modulated light signal comprises light emitted by the lighting unit for illumination.

7. A method as in claim 1 where the selected control element comprises a button on the remote control.

8. A method as in claim 1 where the selected control element comprises a symbol on a touch screen of the remote control.

9. A method as in claim 1 where the selected control element comprises a sound produced by a user.

10. A method of configuring a wireless-controlled lighting system including a group of lighting units, each having a unique identification code, and a remote control, all communicating via commonly-received wireless transmissions, said method comprising:

using the remote control to select one of the lighting units to be a control master for the system;

a. emission by each of the lighting units of a modulated light signal carrying the respective identification code;

b. positioning of the remote control at a location where it receives the modulated light signal from only one of the lighting units;

c. activation of a selected one of a plurality of control elements of the remote control to associate said selected control element with the lighting unit transmitting the modulated light signal being received;

d. transmission from the remote control to the control master for the system of a signal identifying the unique identification code for the lighting unit and the control element with which said lighting unit has been associated; and e. repeating each of steps b through d for each of the remaining lighting units in the group.

11. A method as in claim 10 where each lighting unit in the group includes an adaptable device which selectively operates as either a control master device or a slave device.

12. A method as in claim 10 where the unique identification code is preassigned.

13. A method as in claim 10 where the unique identification code is assigned to each lighting unit when the lighting unit is installed in the system.

14. A method as in claim 10 where each of the lighting units transmits the modulated light signal for a predetermined period after said lighting unit is powered up.

15. A method as in claim 10 where the modulated light signal comprises light emitted by the lighting unit for illumination.

16. A method as in claim 10 where the selected control element comprises a button on the remote control.

17. A method as in claim 10 where the selected control element comprises a symbol on a touch screen of the remote control.

18. A method as in claim 10 where the selected control element comprises a sound produced by a user.

* * * * *